US010443992B2

(12) United States Patent
Cayer

(10) Patent No.: US 10,443,992 B2
(45) Date of Patent: Oct. 15, 2019

(54) NON-PYROTECHNIC DIVERSIONARY DEVICE

(71) Applicant: Applied Research Associates, Inc., Albuquerque, NM (US)

(72) Inventor: Richard Cayer, Littleton, CO (US)

( * ) Notice: Subject to any disclaimer, the term of this patent is extended or adjusted under 35 U.S.C. 154(b) by 194 days.

(21) Appl. No.: 15/466,492

(22) Filed: Mar. 22, 2017

(65) Prior Publication Data

US 2017/0276464 A1 Sep. 28, 2017

Related U.S. Application Data

(60) Provisional application No. 62/312,007, filed on Mar. 23, 2016.

(51) Int. Cl.
*F42B 27/00* (2006.01)
*F42B 12/42* (2006.01)
(Continued)

(52) U.S. Cl.
CPC ..... *F42B 12/42* (2013.01); *F42B 4/04* (2013.01); *F42B 27/00* (2013.01); *F42B 33/02* (2013.01)

(58) Field of Classification Search
CPC ..... F41A 33/04; F42B 12/42
See application file for complete search history.

(56) References Cited

U.S. PATENT DOCUMENTS 5,942,715 A * 8/1999 Denchfield ..... F41A 33/04 102/702
6,767,108 B1 7/2004 Blachowski et al.
(Continued)

FOREIGN PATENT DOCUMENTS

KR 20120166106 A 5/2017

OTHER PUBLICATIONS

International Search Report and Written Opinion pertaining to PCT/US 2017/023741, dated Jun. 26, 2017.

*Primary Examiner* — Gabriel J. Klein
(74) *Attorney, Agent, or Firm* — Dinsmore & Shohl LLP; Monika L'Orsa Jaensson

(57) ABSTRACT

The disclosed technology regards a reusable, non-pyrotechnic diversionary device having a housing assembly which receives and supports a pressure manifold, activation assembly, and a lighting assembly. The housing assembly includes a vessel, a main chassis, and a transparent lens. Positioned within the main chassis is a pressure manifold which supports a compressed gas source. A puncture pin is provided in the activation assembly, and aligned with the compressed gas source to facilitate puncture of the source. The disclosed technology further regards a reusable, non-pyrotechnic diversionary assembly having a housing assembly and a reloading tool. The reloading tool has an externally threaded inner body with an aperture at its distal end sized to receive the puncture pin, and an outer body sized and internally threaded to rotatably receive a portion of the inner body in its shaft, allowing the inner body to traverse through and from the shaft at its distal end. A threaded interface is provided on the outer body of the reloading tool to align with the first support structure of the pressure manifold. The inner body rotationally translates within the outer body to position the distal end of the inner body relative to the puncture pin and allow it to translate the puncture pin from an active position to a secured position.

17 Claims, 8 Drawing Sheets

(51) Int. Cl.
*F42B 33/02* (2006.01)
*F42B 4/04* (2006.01)

(56) References Cited

U.S. PATENT DOCUMENTS

| | | | | |
|---|---|---|---|---|
| 7,191,708 | B2 | 3/2007 | Ouliarin | |
| 7,905,179 | B2 * | 3/2011 | Brock | F41A 33/04 102/367 |
| 7,958,827 | B1 * | 6/2011 | Brock | F41A 33/04 102/498 |
| 8,113,689 | B2 | 2/2012 | Mayo et al. | |
| 8,117,966 | B1 * | 2/2012 | Graber | F42B 8/26 102/367 |
| 8,904,940 | B1 * | 12/2014 | Pann | F42B 27/00 102/368 |
| 9,016,888 | B2 * | 4/2015 | Glynn | F41H 13/0081 102/502 |
| 9,574,858 | B2 * | 2/2017 | Graber | F42B 12/50 |
| 2006/0081147 | A1 * | 4/2006 | Walsh | F41H 9/10 102/368 |
| 2006/0166171 | A1 * | 7/2006 | Preston | F42B 8/00 434/16 |
| 2006/0233050 | A1 * | 10/2006 | Unsworth | A63H 5/04 367/144 |
| 2008/0216699 | A1 | 9/2008 | McAleer et al. | |
| 2010/0282109 | A1 | 11/2010 | Caldwell | |
| 2011/0306446 | A1 * | 12/2011 | Frank | F42B 8/26 473/577 |
| 2012/0288830 | A1 * | 11/2012 | Van Zuilen | F41A 33/00 434/11 |
| 2015/0308801 | A1 | 10/2015 | Thomas | |

* cited by examiner

NON-PYROTECHNIC DIVERSIONARY DEVICE

GOVERNMENT INTEREST

This invention was made with the support of the United States government under contract number N41756-15-C-3337 awarded by the Technical Support Working Group, Department of Defense. The government has certain rights to this invention.

BACKGROUND

The disclosed technology regards a reusable diversionary device that uses non-pyrotechnic components to generate sound, light, and concussive force upon rupture.

Pyrotechnic diversionary devices, or flash-bang devices, are used to create an element of surprise during tactical entry operations by using intense sound, light, and pressure (concussive force) to render targeted adversaries momentarily stunned and confused. Typically, these devices use pyrotechnics to create the "light" or "flash" portion, which can be highly unsafe or dangerous in certain environments, and because of the of the pyrotechnic nature these devices, they are typically single use only.

The Non-Pyrotechnic Diversionary Device (NPDD) of the disclosed technology uses non-pyrotechnic components that are capable of generating similar effects to a traditional pyrotechnic-based device (i.e., light, sound, and concussive force) but without the flame or obscuring smoke associated with conventional flash-bang devices. The NPDD further controls the bursting effect of the device, minimizing any projectiles, shrapnel or other pieces of the technology from breaking off and potentially causing unintended injury. By its design and configuration, all but a few components of the NPDD are reusable, and the remaining components are replaceable. Furthermore, the NPDD may be of similar size and shape to a traditional pyrotechnic flash-bang device, and can fit existing carrier pouches. As a result, operators (i.e., Special Forces, Military, specialized law enforcement units, Federal agencies, or other users) may use the NPDD in situations that would normally preclude the use of traditional pyrotechnic flash-bang device.

GENERAL DESCRIPTION

The disclosed technology includes a replaceable and customizable vessel that is ruptured by pressurized gas to create a selective concussive force. Further, a series of high-intensity lights can be coupled with the device to cause further distraction and possibly even temporary flash blindness. The NPDD is intrinsically safe (nonlethal and non-combustible) for use in compromised environments, and is generally reusable, requiring only replacement of the vessel and the compressed gas source; in some configurations, the NPDD further is sealed to protect against ingress of water and foreign particulates, with a watertight Ingress Protection rating of up to IP67.

Generally, the disclosed technology includes a reusable, non-pyrotechnic diversionary device having a housing assembly, a pressure manifold, an activation assembly, and a lighting assembly.

The housing assembly of the disclosed technology has a vessel, a main chassis, and a transparent lens. The vessel is removably secured to a first end of the main chassis and is defined by a perimeter wall having two or more propagation crevices extending from a pinnacle of a base of the vessel, along at least a portion of a length of the vessel. The transparent lens may be secured at, near or, about at least a portion of the second end of the vessel.

The main chassis of the housing assembly is a cylinder defining a vacuous area, with a firewall or similar structure across the vacuous area of the main chassis to separate a high pressure side on the first end of the main chassis, and a low pressure side on a second end of the main chassis. The main chassis receives and supports the pressure manifold, the activation assembly, and the lighting assembly of the disclosed technology.

The pressure manifold of the disclosed technology is positioned within the main chassis, and includes structure to support a compressed gas source within the housing assembly. The activation assembly generally includes a puncture pin aligned with the compressed gas source support structure, translatable between a secured position and an active position. The lighting assembly of the disclosed technology includes a plurality of high-intensity lights and an energy source, and is positioned near the transparent lens.

In use, a replaceable pressurized gas cylinder is secured within the main chassis, and upon deployment punctured by a puncture pin of the activation assembly. This releases and routs compressed gas into a vacuous area defined by the vessel, causing it to become over-pressured and rupture. The rupture and subsequent release of the contained pressure creates a desired concussive force and an acoustic impulse, and when detected may initiate a light or flash sequence.

The disclosed technology further regards a reusable, non-pyrotechnic diversionary assembly having a housing assembly; an activation assembly including a puncture pin aligned with a compressed gas source support structure; and a reloading tool for re-cocking the activation assembly, the reloading tool being designed and configured to be received in the gas source support structure, after removal of the gas source. The housing assembly includes a vessel and a main chassis, wherein the main chassis supports the gas source support structure and the activation assembly. The vessel is removably secured to a first end of the main chassis, and has a perimeter wall with two or more propagation crevices extending from a pinnacle of a base of the vessel, along at least a portion of a length of the vessel. The gas source support structure may be a pressure manifold, including an aperture to support the compressed gas source within the housing assembly.

The reloading tool has an externally threaded pin with an aperture at its distal end sized to receive the puncture pin. The reloading tool further has an outer body sized and internally threaded to rotatably receive the inner body, allowing the inner body to traverse through the proximal and distal ends of the outer body throughout its length, protruding at its distal end. The reloading tool outer body is sized to be received and removably secured at its distal end within the aperture of the pressure manifold. A threaded interface is provided on the outer body of the reloading tool to align with the gas support structure of the main chassis. The inner body rotationally translates within the outer body to position the distal end of the inner body relative to the puncture pin and allow it to translate the puncture pin from an active position to a secured position.

These and other aspects and advantages of the disclosed technology will become more clear after careful consideration is given to the following detailed description of the exemplary embodiments thereof.

DESCRIPTION OF THE FIGURES

The disclosed embodiments of the present invention will be better and more completely understood by referring to the following detailed description of exemplary non-limiting illustrative embodiments in conjunction with the drawings of which.

DETAILED DESCRIPTION

As shown in the Figures, the disclosed technology regards a non-pyrotechnic diversionary device having a housing assembly (81), a pressure manifold (14) secured within the housing assembly, an activation assembly (80), and a lighting assembly (79).

Figure 1:
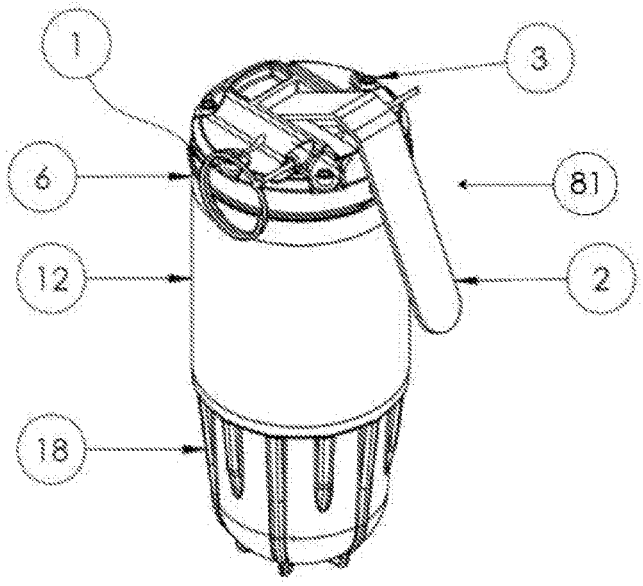
FIG. 1 is a perspective view of an embodiment of the disclosed technology.
Figure 2:
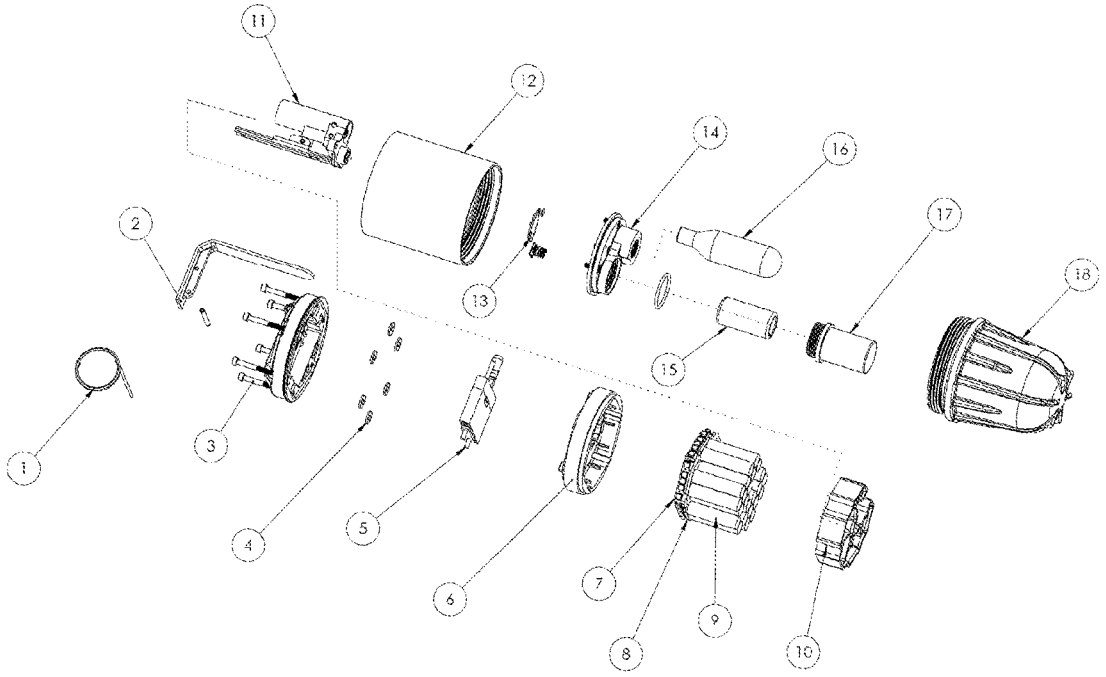
FIG. 2 is a component, disassembled view of an embodiment of the disclosed technology.
Figure 3A:
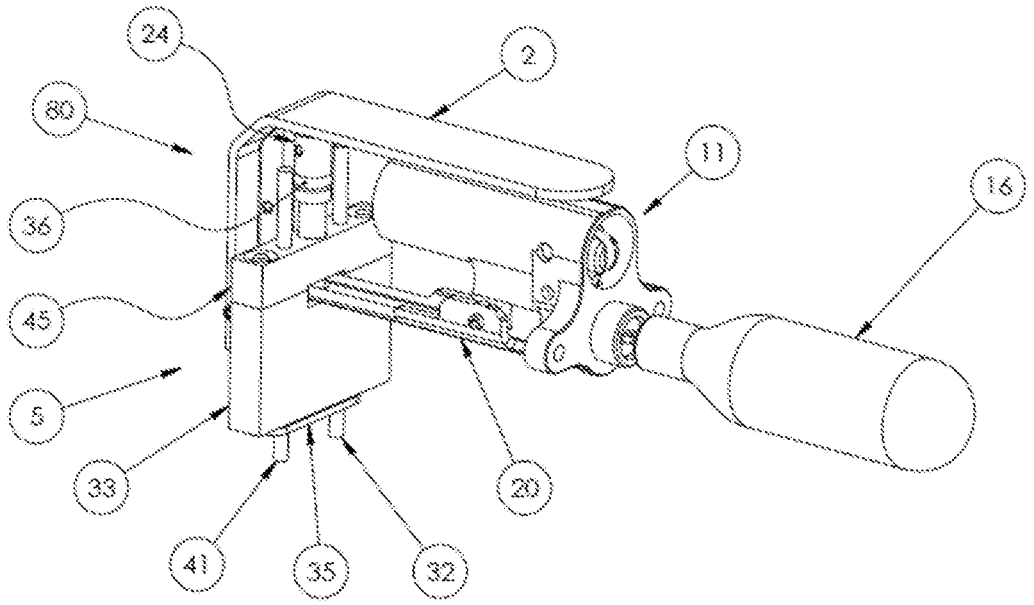
FIG. 3A is perspective view of an embodiment of an activation assembly of the disclosed technology, in the secured position.
Figure 3B:
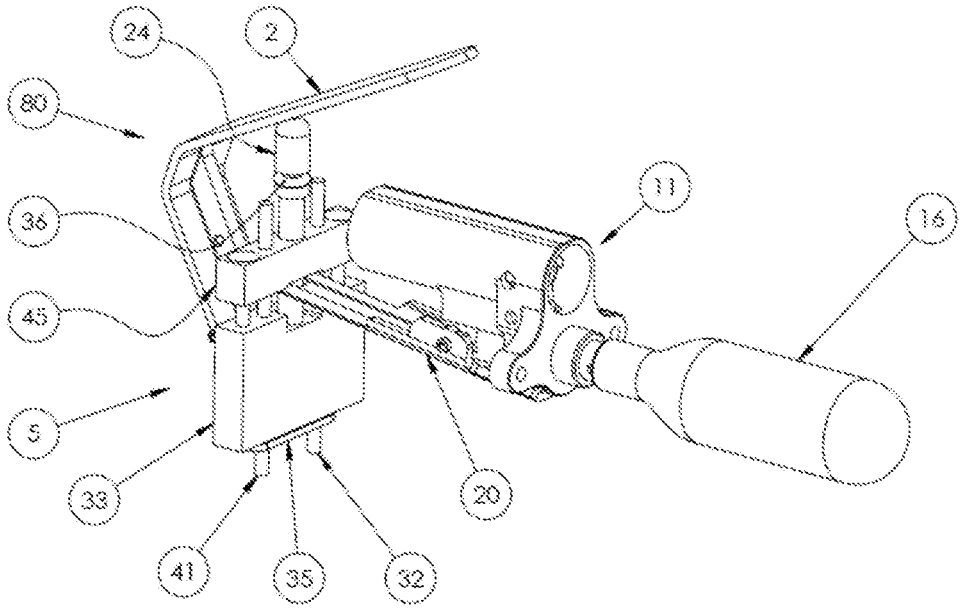
FIG. 3B is a perspective view of the embodiment of the activation assembly of FIG. 3A, in the active position.
Figure 10:
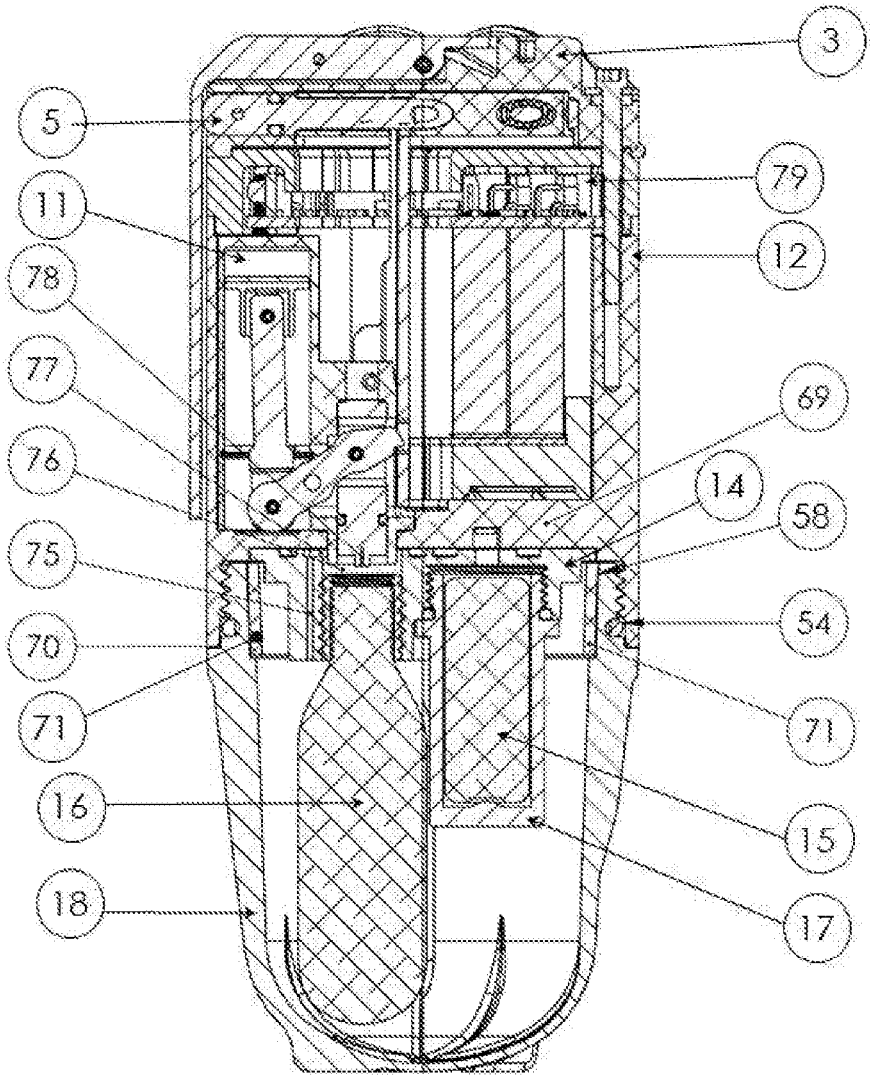
FIG. 10 is a cross-sectional view of an embodiment of the diversionary device of the disclosed technology.
Figure 11:
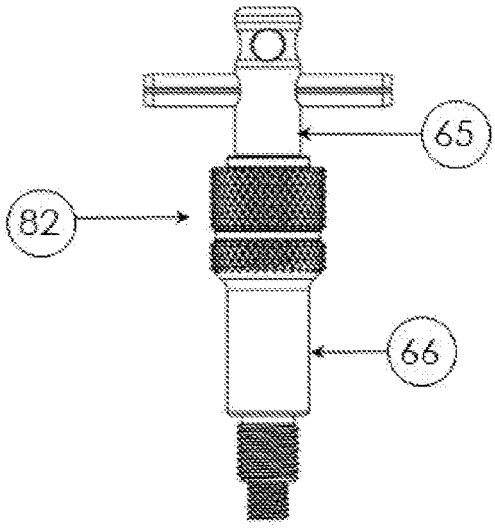
FIG. 11 is a front view of an embodiment of reloading tool of the disclosed technology.
Figure 12A:
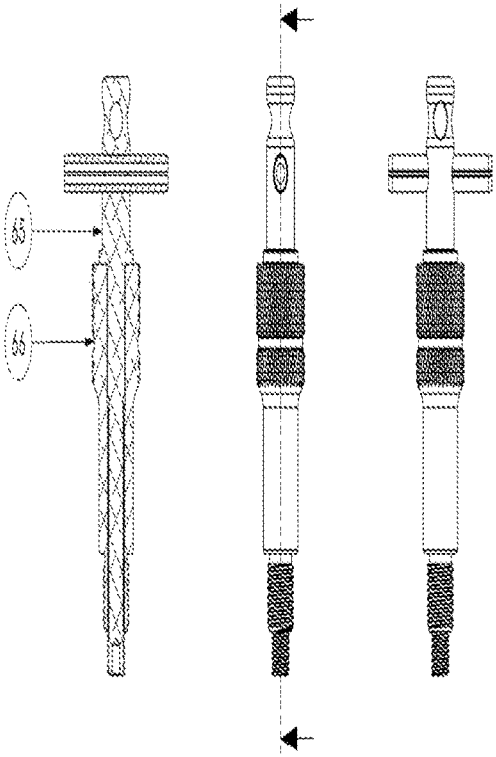
FIG. 12A is a cross-sectional view of the embodiment of the reloading tool of FIG. 11.
Figure 12B:
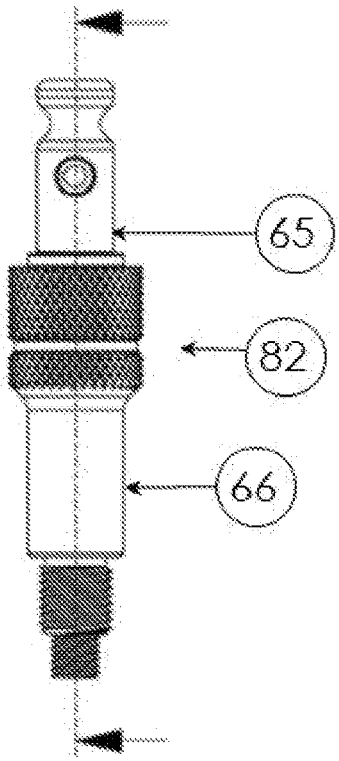
FIG. 12B is a side view of the embodiment of the reloading tool in FIG. 11.

In embodiments of the disclosed technology, the housing assembly (81) includes a vessel (18), a main chassis (12), a top cap (3), and a transparent lens (6), wherein the top cap and the vessel are secured to opposing ends of the main chassis (see FIGS. 1, 2, 10).

Figure 4A:
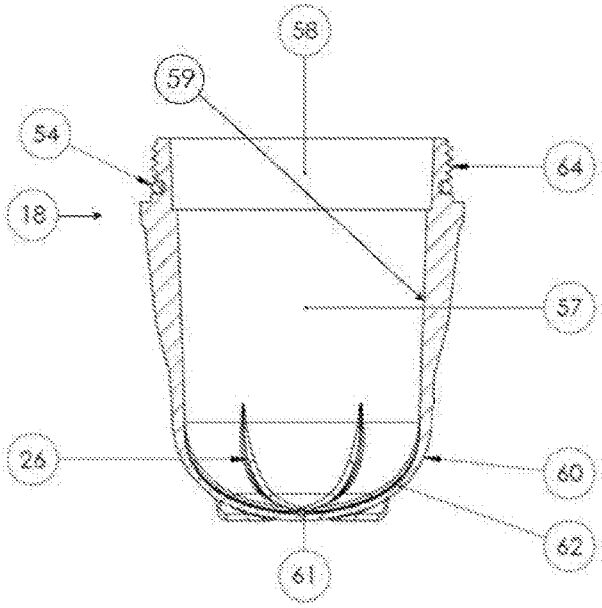
FIG. 4A is a cross-sectional view of an embodiment of a vessel of the disclosed technology.
Figure 4B:
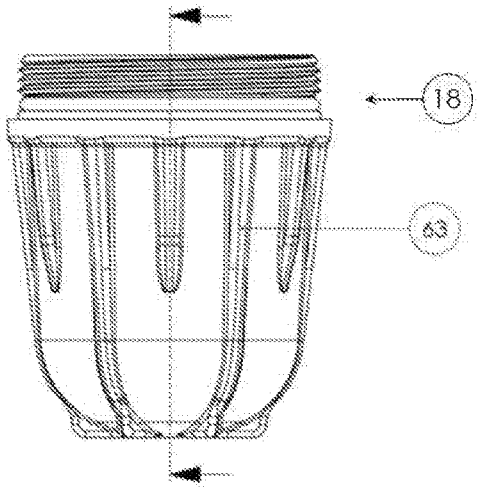
FIG. 4B is a front view of the embodiment of the vessel of FIG. 4A.

The vessel (18) is defined by a perimeter wall (62) forming an open top (58), a closed base (61) having a pinnacle, and a vacuous area (57) within the vessel, wherein the perimeter wall has an interior surface (59) and an exterior surface (60) (see FIG. 4A, 4B). The perimeter wall has a thickness of between about 1/32" and 1/8", or between about 1/16" and 3/32", which form generally a prolate spheroid dome. The vessel is made from a polymer material, such as for example a high density polyethylene, a low density polyethylene, polyurethane, rubber, or metallic material.

As shown in the embodiment of FIGS. 4A and 4B, the surface of the vessel perimeter wall includes one or more propagation crevices (26) to guide the rupture of the vessel, from the pinnacle along one or more propagation crevices, typically along two opposing crevices. The propagation crevices extend from the base (61) of the vessel, along at least a portion of a length of the vessel, the crevices being generally semicircular or elliptical in shape. The propagation crevices result in a reduced wall thickness at the crevices, as compared to the general thickness of the perimeter wall, the reduced wall thickness being between about 1/4 to 1/2 of the general wall thickness at the pinnacle of the base, wherein the depth of each crevice may decrease along its length. The propagation crevices traverse between about 1/8 and 1/2, or 1/3 of the length of the vessel, from about the pinnacle of the base. The vessel may have at least two propagation crevices; in some embodiments the vessel has six or more propagation crevices. The propagation crevices may be positioned equidistant about a circumference of the vessel. In the embodiments shown, the propagation crevices can be positioned on the interior surface (59) (as shown in FIG. 4A) or exterior surface (60) of the vessel.

The exterior surface (60) of the vessel perimeter wall may include one or more ridges (63) to strengthen the vessel, control the bursting effect and minimize any projectiles in the burst of the vessel (see FIG. 4A, 4B). The ridges may be positioned equidistant about a circumference of the vessel. Some of the ridges may extend the entire length of the vessel, protruding at the bottom to form a wedge, thereby allowing the vessel to rest on its end when not in use and facilitate removal of the vessel from the chassis. Other ridges may extend only partially (about 1/2 of the length of the vessel, from the open top), and are aligned with the propagation crevices (26), serving to reduce fissure of the vessel along the line of a propagation crevice, and thereby reduce or eliminate disintegration of the vessel upon rupture, leaving the vessel only deformed.

In the embodiment shown in FIGS. 1, 2, 4A, 4B, and 10, the vessel (18) has a threaded surface (64) at the vessel's open top (58), designed and configured to be suitable for threaded engagement with the threaded surface of a first end (70) of the main chassis (12).

The size, shape, and material of the vessel and the number, depth and length of the propagation crevices are selected to determine the pressure at which the vessel will rupture, the pressure of the concussive force generated upon rupture and an intensity of the acoustic impulse generated upon rupture. In some embodiments the rupture of the vessel generates a concussive force of ≥0.0001 psi, or ≥0.6 psi, above ambient pressure; and an acoustic impulse of ≥90 dB, or ≥166 dB, when measured at 6'. The assembly may include a plurality of vessels for individual, selective engagement with the main chassis, wherein each of the plurality of vessels has different materials, shapes, sizes, or propagation crevice number, size or length, or any combination thereof, providing varying concussive force and sound intensity upon rupture. Table 1 provides exemplary data of the effect of propagation line depth and vessel material on the acoustic impulse generated by a device as herein described.

TABLE 1

Effect of propagation line depth and material on acoustic impulse

| Propagation line depth | Vessel Material | Acoustic Impulse |
|---|---|---|
| 0.050" | High Density Polyethylene | 166 dB |
| 0.050" | Low Density Polyethylene | 157 dB |
| 0.020" | Polyurethane | 134 dB |
| 0.035" | Polyurethane | 141 dB |

As shown in FIGS. 2 and 10, the main chassis (12) includes an open cylinder, has a firewall (69) integral with the walls of the main chassis, and is further sized and configured to receive and house a fuse assembly (11). The chassis is further designed and configured to support within its interior a pressure manifold (14), with the manifold affixed to the firewall, and a lighting assembly (79). The main chassis may have a threaded surface at its first end (70), suitable for threaded engagement with the threaded surface (64) of the open end of the vessel.

The firewall (69) of the main chassis may be integral with the cylinder, and separates low pressure (second end) and high pressure (first end) areas of the main chassis (12). The pressure manifold (14) may be supported by and secured to the high pressure side of the firewall by a plurality of affixation means, such as screws through aligned corresponding apertures in the manifold and the firewall. An aperture is formed in the firewall to receive and allow the translation of the puncture pin of the pressure activation assembly, and recessed areas may be formed into the firewall to receive a pressure transducer, and a spring contact for engagement with the energy source, all as hereinafter described.

The main chassis (12) may include a plurality of apertures within its walls to receive the affixation means of the top cap (3) and facilitate securement of the top cap and the lighting assembly relative to the main chassis. The main chassis may further have a ledge formed about its circumference at its second end, designed and configured to receive in seating engagement a portion of the transparent lens (6).

As shown in the embodiment of FIGS. 1, 2, 8A, 8B, and 10, the top cap (3) of the housing assembly may be a cylindrical structure having a plurality of fixation means, such as for example screws or rivets, to secure the top cap to the lighting assembly (79) and the main chassis (12), through apertures aligned among the components. The top cap further has means to hingedly secure the spoon lever (2) of the activation assembly (80), and an aperture (49) sized and configured to receive and stabilize at least a portion of the trolley (11), with an open plunger channel (48) to expose and permit movement of the plunger (24) of the trolley as hereinafter described. A ledge may be provided on the rim of the top cap for seating engagement with the transparent lens (6).

The housing may be sealed for Ingress Protection rating of up to 67 by means of a plurality of O-rings at the affixation means of the top cap (3), and one or more gaskets on either or both sides of the transparent lens (6), as the sides abut respectively against the top cap and the main chassis. An O-ring (54) or similar structure may be positioned above the threads of the main chassis to maintain pressure in the vessel (18) until rupture. The open top of the vessel may include a recessed portion, about its circumference, to allow seating engagement of the pressure manifold (14) within the vessel as shown in FIG. 10.

As shown in FIG. 10, the housing supports within its interior the pressure manifold (14) of the disclosed technology, at the firewall (69) of the main chassis, the pressure manifold being designed and configured to support a compressed gas source (shown as 16 in FIGS. 2, 3A, 3B, 10). The pressure manifold may be further designed and configured to support an energy source (shown as 15 in FIGS. 2, 5, 10) for the lighting assembly. In some embodiments the pressure manifold may be integral with the firewall, forming a single component.

Figure 6:
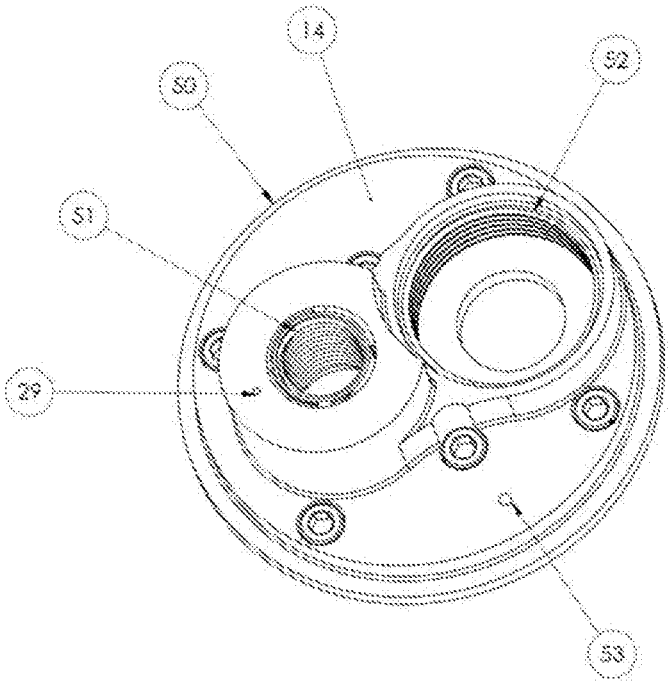
FIG. 6 is a peripheral view of an embodiment of a pressure manifold of the disclosed technology.
Figure 7A:
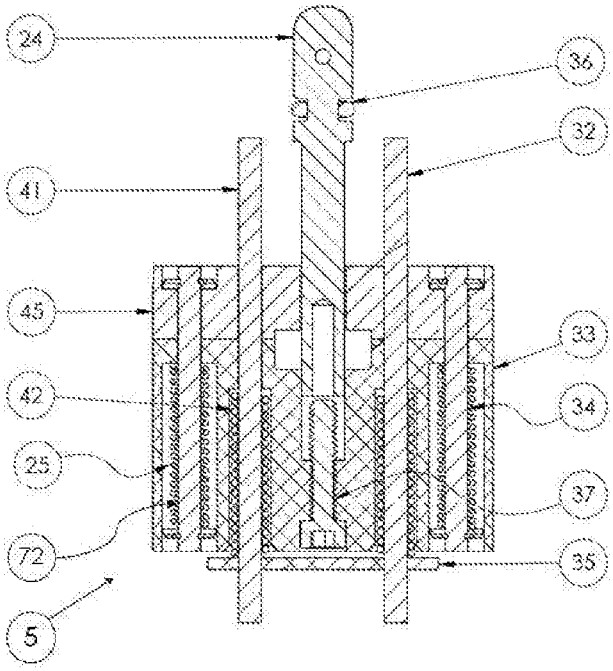
FIG. 7A is a cross-sectional view of an embodiment of a trolley assembly of the disclosed technology, in the secured position.
Figure 7B:
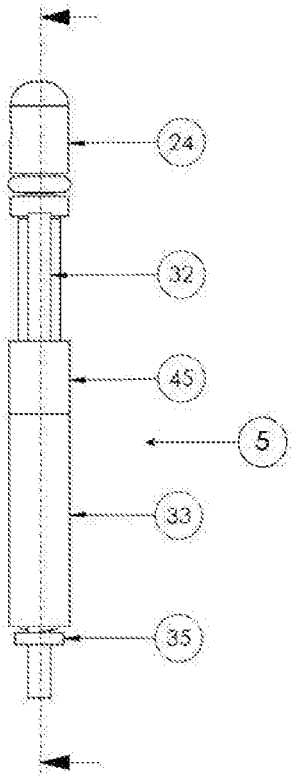
FIG. 7B is a side view of the trolley assembly of FIG. 7A.

In some embodiments, as shown in FIG. 6, the pressure manifold (14) includes a base (50), a first manifold support structure (51) to receive and support a compressed gas source (cylinder), and a second manifold support structure (52) to receive, support and engage an energy source (e.g., a battery) with the lighting assembly. The first and second manifold structures may be independent structures, or combined into a unitary structure, affixed to or integral with the base.

The first manifold support structure (51) may be a cylindrical structure having a threaded aperture, the aperture being defined by a depth and width to receive and removably secure at least a portion of the threaded neck of the compressed gas source (16), aligned with the puncture pin of the activation assembly.

Figure 13:
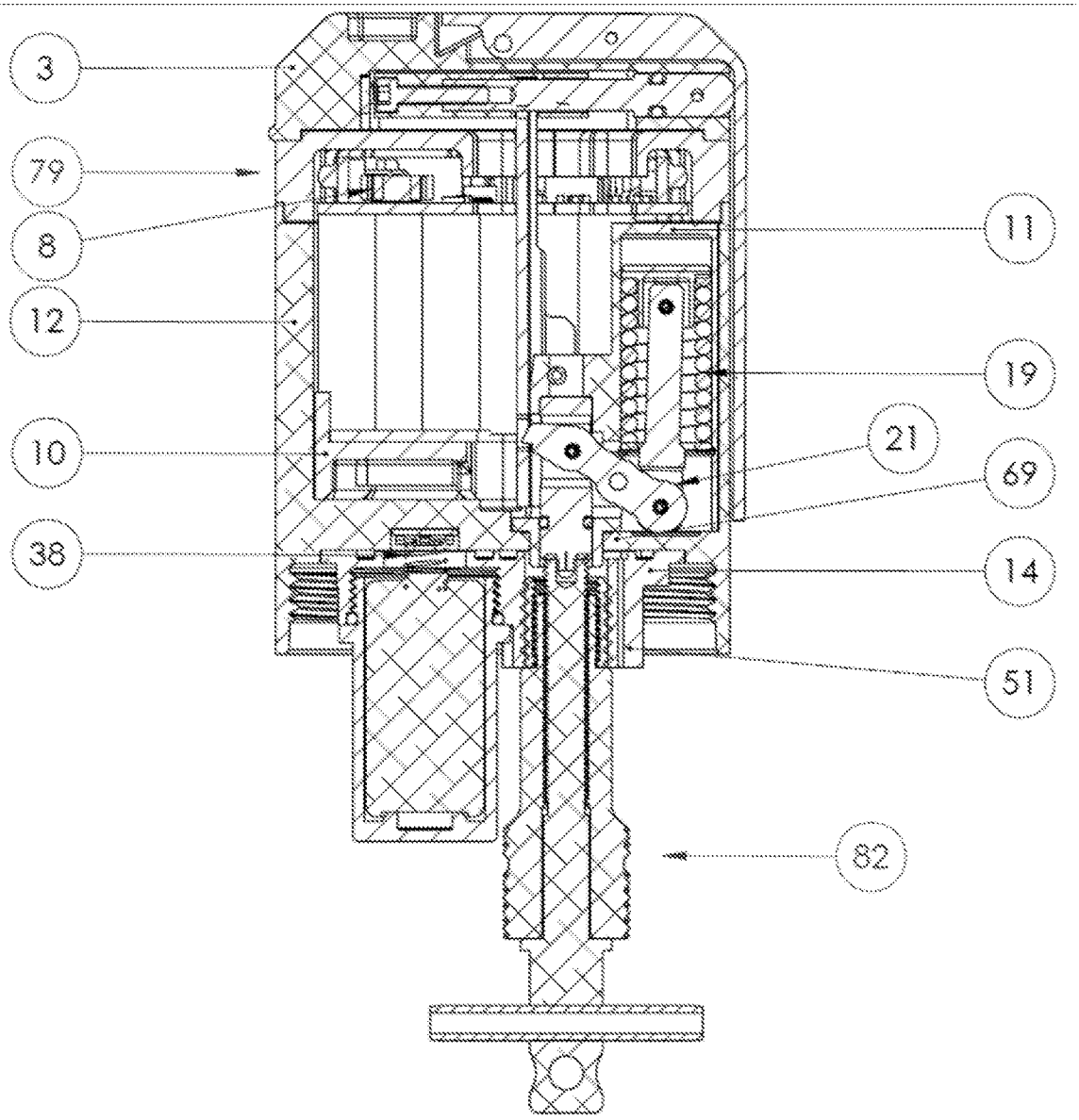
FIG. 13 is a cross-sectional view of an embodiment of the disclosed technology, with a reloading tool secured within an aperture of the gas source support structure.

The second manifold support structure (52) may be a cylindrical structure having a threaded aperture, the aperture being defined to receive and secure an energy source (15) for the lighting assembly. For example, an energy source cap (17) may be designed and configured to encapsulate the energy source with the second manifold structure, when the energy source cap is engaged with the second manifold support structure, to facilitate engagement of the energy source (15) with a spring contact (38) of the second manifold support structure, the base or the firewall. In such a configuration, the aperture of the second manifold support structure may be defined by a depth and width to receive and secure the threaded end of an energy source cap (17). Other means for removably securing an energy source (15) or an energy source cap (17) may be employed, and the energy source may be provided with the device of the disclosed technology, or may be supplied independent thereof. The spring contact (38) is in wired communication with the supercapacitors (9) of the lighting assembly (79), being affixed to the second manifold support structure, the base or the firewall, thereby transmitting energy from the power source (15) to the supercapacitors (9). The board of the spring contact may be fixed into place on the firewall (as shown in FIG. 13), the base or the second manifold support structure by means of, for example, glue or epoxy or by mechanical means, such as screws or rivets.

As shown in the embodiment of FIGS. 6, the pressure manifold includes means to control pressure buildup within the high pressure portion of the main chassis when the vessel is secured thereto, such as an orifice (29). The orifice may be positioned through at least a portion of the first manifold support structure, the second manifold support structure, or the base, with an opening on a top face of the pressure manifold. The orifice may have a cross-sectional area of at least 0.0004 $in^2$, or about 0.0007 $in^2$, or greater. In some embodiments the opening is integral with the top face of the first manifold support structure, as shown in FIG. 6. As shown below in Table 2, the orifice is sized to facilitate and control the flow of gas from the compressed gas source to the vacuous area (57) of the vessel (18), and thereby control the rate of pressure build-up within the vacuous area of the vessel, which results in a relatively certain delay before rupture of the vessel. As shown in FIG. 10, to further control the flow of gas from the compressed gas source through the orifice to the vacuous area of the vessel, one or more routing cavities (75, 76, 77, 78) may be incorporated into the puncture pin, the base, the first manifold support structure, and/or the second manifold support structure.

TABLE 2

| Variable fuse delay by way of calibrated orifice diameter | |
|---|---|
| Orifice Area | Fuse Delay Time |
| $7.67 * 10^{-4}$ in$^2$ | 0.6 seconds |
| $4.53 * 10^{-4}$ in$^2$ | 1.5 seconds |

The pressure manifold may include a cylinder (71) about its circumference, designed and configured to be supported on a ledge within the interior of the main chassis, and by the recessed portion of the vessel. The cylinder may be affixed about the pressure manifold, or integral with the pressure manifold.

The compressed gas source (16) may be a compressed gas cylinder having a puncturable membrane at one end. The compressed gas cylinder may contain $CO_2$, $N_2$, or other compressible gases, and may have between about 8 g and 24 g, or even up to or beyond 64 g or more compressible gas. The compressed gas cylinder should have a structure (such as a threaded neck) for engagement with the aperture of the first manifold support structure, noting that other configurations of engaging the cylinder with the pressure manifold may be suitable. The compressed gas source (16) may be provided with the device of the disclosed technology, or may be supplied independent thereof.

The activation assembly (80) includes a puncture pin (22) aligned with the aperture of the first manifold support structure, or other means to puncture or release gas from a compressed gas source. In the embodiments shown in FIGS. 3A, 3B, 7A, 7B, 8A, 9A and 9B, the activation assembly further includes a spoon lever (2), a trolley assembly (5) and a fuse train assembly (11). As shown in FIG. 1, the spoon lever (2) may be rotatably secured to the top cap by means of a hinge pin near one end of the spoon lever, and is designed and configured to secure the position of the trolley assembly (5) in a secured position, or allow the trolley (by its spring force) to assume an active position.

The top cap (3) and the spoon lever (2) may include corresponding apertures to receive and allow the removal of a pull pin (1), wherein when the pull pin is received in the corresponding apertures, the pin secures the spoon lever in a secured position; when the pull pin is removed from the apertures, the spoon lever may be rotated into an active position by the spring force of the trolley assembly (5). The pull pin (1) may secured against unintentional removal by bending the end thereof when positioned within the corresponding apertures; to remove the pull pin, the ring may be pulled away from the apertures, causing the end of the pin to straighten as it is pulled through and removed from the apertures.

In the embodiment shown in FIGS. 3A, 3B, 7A and 7B, the trolley assembly (5) includes a front trolley slider (33) and a rear trolley slider (45), a spoon plunger (24) and a plurality of guide rods (32, 34, 41, 72). The spoon plunger may have an O-ring (36) about its neck to limit the longitudinal movement of the trolley when released to the active position, and to seal the plunger channel (48) of the top cap. When the spoon lever (2) is positioned and secured by means of the pull pin in the secured position, the spoon lever secures the spoon plunger in a depressed (lowered) position; when the pull pin is removed from the aperture of the spoon lever, the spring load of the trolley (5) is released, which translates longitudinally the spoon plunger (24) from a secured position to an active position, repositioning the spoon lever (2) into its active (raised) position by the force (translation) of the spoon plunger (24).

Figure 8A:
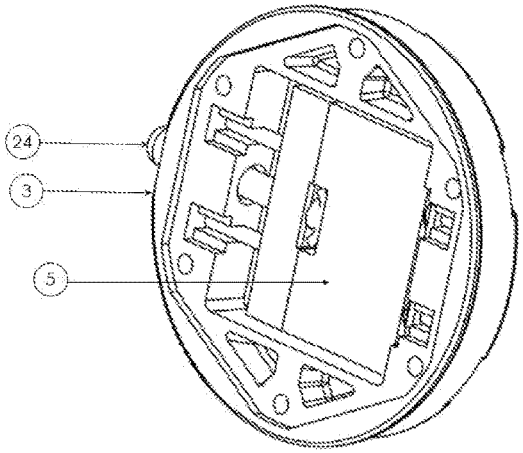
FIG. 8A is a bottom view of an embodiment of the trolley assembly positioned within an aperture of a top cap of the disclosed technology.
Figure 8B:
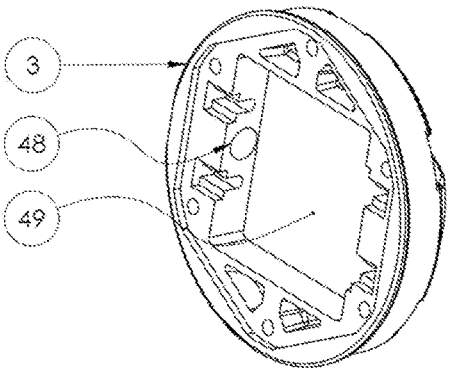
FIG. 8B is the bottom view of the top cap of FIG. 8A.

The spring-loaded trolley (5) as depicted in the embodiments shown in FIGS. 3A, 3B, 7A and 7B includes a plurality of apertures to receive the spoon plunger (24), and one or more guide rods (32, 34, 41 and 72), by means of which the trolley assembly may move longitudinally relative to the guide rods, between an active position and a secured position. The upper ends of some of the guide rods, or trolley return rods (34, 72), are secured to and move with the front trolley (45), and as shown in FIG. 8A the lower ends of other guide rods (32, 41) are secured in a stationary position between the top cap (3), the lighting assembly (79) and in apertures of a spring backing plate (35).

A rear trolley slider (33) may also be provided on the spring-loaded trolley, the rear trolley slider having apertures aligned with the apertures of the front trolley (45) to receive the guide rods (32, 34, 41 and 72), and movable with or independent of the front trolley. To spring load the front and rear trolleys, a plurality of linear springs (25, 42) are engaged with the guide rods (32, 41) and the trolley return rods (34, 72). The linear springs are compressed in the housing when the trolley is in a secured position, but when the plunger is released (pull pin being removed from the spoon lever, as hereinabove described) the springs uncompress, causing the trolley return rods (34, 72) to translate forward in the housing, moving the trolleys (33, 45) to an active position. A fastening screw (37) is provided in the rear trolley slider, aligned with an aperture of the spoon plunger, to secure the rear trolley slider and the spoon plunger.

The rear trolley slider (33) and the front trolley (45) have corresponding elongated receptacles along at least a central portion thereof, to receive and secure an end of the sear lever (20) of the fuse train assembly when the trolley (5) is in a secure position, and release the sear lever of the fuse train assembly when the trolley is in an active position. As shown in FIG. 9C, the sear lever may have a semicircular opening at its end to receive a portion of the leg of the spoon plunger (24).

Figure 9A:
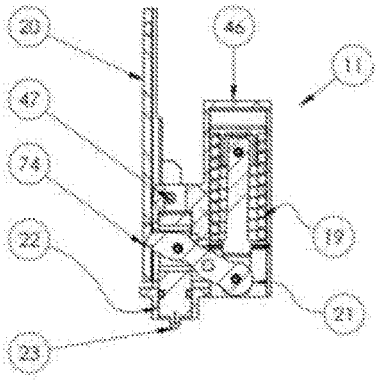
FIG. 9A is a partial cross-sectional view of an embodiment of a fuse train assembly of the disclosed technology, in the secured position.
Figure 9B:
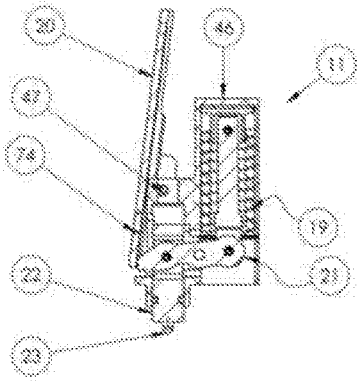
FIG. 9B is a partial cross-sectional view of an embodiment of a fuse train assembly of the disclosed technology, in the active position.
Figure 9C:
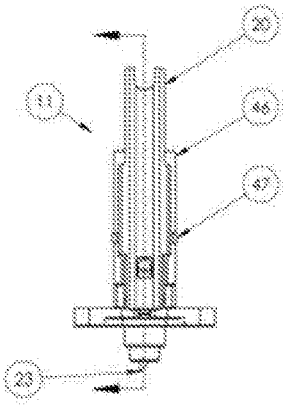
FIG. 9C is a front view of the fuse train assembly of FIG. 9B.

Referring to the embodiments shown in FIGS. 3A, 3B, 9A and 9B, the fuse train assembly (11) of the activation assembly includes means to translate the puncture pin (22) to the aperture of the first manifold support structure. In the embodiment shown, the fuse train assembly includes a fuse train housing (46), a sear lever (20), a main spring (19) secured within the fuse train housing, a puncture pin transfer bar (21), and the puncture pin (22) having a puncture pin tip (23). The sear lever (20) is rotatably mounted on the fuse train housing by means of, for example, a hinge pin (47), rotating between a secure position and an activated position, so that when the spoon plunger (24) is released and extends outward from the trolley assembly (5), the sear lever is released from the secured position by the translation of the rear trolley (the trolley groove repositioning to release the sear lever) and rotates from the secure position (FIG. 9A) to the activated position (FIG. 9B).

As shown in FIGS. 9A and 9B, the puncture pin transfer bar (21) may be rotatably mounted on the fuse train housing, with one end of the puncture pin transfer bar being engaged with the main spring (19) which holds the puncture pin transfer bar in the secure position until a greater force is applied to the sear lever (20) on the side opposite the engagement surface (74) of the sear lever, causing the engagement surface of the puncture pin transfer bar to release from engagement with the sear lever (20). Thereby, in the secured position the puncture pin transfer bar is held in static equilibrium between the force acting on an engagement surface (74) positioned in contact with and translating movement among the sear lever and the puncture pin transfer bar, and the force of the main spring. In this embodiment, when the sear lever is released and rotates into its active position, the engagement surface is released and the puncture pin transfer bar begins rotating due the opposing (greater) force of the main spring, thereby causing sufficient rotation of the puncture pin transfer bar, wherein rotation of the puncture pin transfer bar translates the puncture pin into the aperture of the first manifold support structure (51) or other compressed gas support structure, and causes the tip of the puncture pin to impinge upon the membrane of the gas cylinder with a force sufficient to puncture the gas cylinder and release the compressed gas.

The released gas then passes from the cylinder, through the routing cavities and out the orifice, into the high pressure side of the main chassis and the vacuous area of the vessel. When the pressure passes the designed pressure capacity of the vessel, the vessel will burst along at least one or more of the propagation lines, causing an acoustic impulse and a concussive force, as designed by the vessel. Once the vessel bursts, the pressure on the high pressure side of the main chassis returns to atmospheric pressure, and the pressure sensor may detect the pressure drop and communicate it to the lighting assembly. The lighting assembly then commences its lighting routine, as programmed on the light controlling circuitry, all as hereinafter described.

Figure 5:
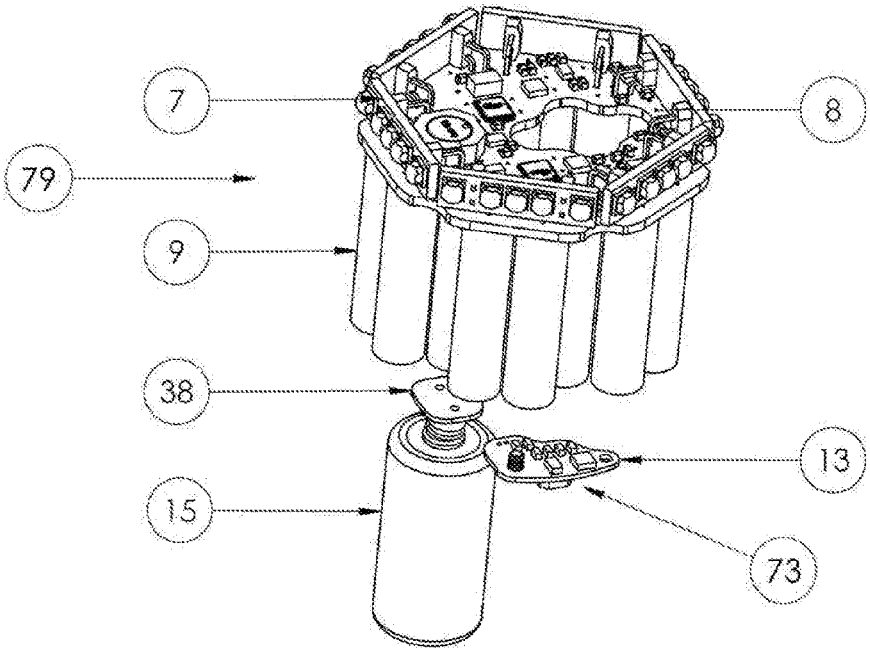
FIG. 5 is a peripheral view of components of an embodiment of a lighting assembly of the disclosed technology.

The disclosed technology further includes a lighting assembly (79), as shown in the embodiment of FIG. 5, having a pressure detection assembly (13), a plurality of high-intensity lights (7), light controlling circuitry (8), and a plurality of supercapacitors (9) powered by the energy source (15). In an embodiment the lights, the circuitry, and an end of the supercapacitors are potted within the inner cavity of the transparent lens (6), in an epoxy or similar potting compound, to form a subassembly. The potted subassembly may have a plurality of apertures to receive the affixation means of the top cap, securing the lighting assembly between the top cap and the main chassis. The transparent lens is provided about the circumference of the potted assembly, and may have a recessed portion about its circumference at each end for seating engagement with each of the circumferential ledge of the main chassis and the circumferential ledge of the top cap. The plurality of high intensity lights positioned about the light support structure are controlled by the electronic circuit (8), and are powered by a bank of 1 to 100 supercapacitors (9), which may also be affixed to LED support structure (circuit board[s]). The high-intensity lights may include a parallel or series array of 1 to 100 Light Emitting Diodes (LEDs) which typically emit light in the visible spectrum (390 to 750 nanometers). Total light output is proportional to the power (the product of the current and electrical potential) driving the LEDs, and may be user configurable depending on the desired brightness of the device. The LED may be any LED that emits light primarily in the visible spectrum or in the IR spectrum (700 to 1000 nanometers).

The pressure detection assembly (13) includes a pressure sensor (73) for detecting pressure within the conjoining high pressure side of the manifold and the vacuous area of the vessel, and circuitry to communicate to the lighting device a condition of pressure drop caused by the rupture of the vessel. In an embodiment, the transducer of the pressure sensor is affixed to and supported in a pocket of the main chassis and monitors pressure in the vacuous area of the vessel using an orifice on the pressure manifold (53), on the high pressure side of the firewall, and secured with epoxy, potting compound, or glue. The electronic circuit (8) includes a programmable controller which receives the signal representing a condition of pressure drop from the pressure detection assembly, and initiates the LED flash sequence. The electronic circuit can be configured for single or multiple flash sequences, as well as configurable flash duration.

The electrical power source powers the bank of supercapacitors (9) (by wires from the spring contact), allowing the bank of supercapacitors to rapid power discharge to the LED array, creating a light output of ≥600 lux seconds of total light output when measured at 11' 2". As shown in FIGS. 2 and 13, a volume spacer (10) may be positioned within the main chassis to hold and secure the upper ends of the supercapacitors within the volume of the chassis, with the upper end of the volume spacer abutting the low pressure side of the firewall (69). The supercapacitor energy may be replenished with a replaceable electrical energy source (15) and an energy source cap (17) designed and configured to be received and secured by the aperture of the second manifold support structure, as shown in FIGS. 2 and 10. The energy source may be a primary or secondary battery, capacitor, or wall powered electrical energy source. Furthermore, the energy source may be removed to disable the light portion of the disclosed technology, and allow the device of the disclosed technology to be used just as a concussive force/sound diversionary device.

The chassis (12), trolley assembly (5), top cap (3), spoon (2), manifold (14), electrical source protective sleeve (17), fuse train (11), and other components may be constructed of metallic or plastic materials. The device of the present technology may have a length of about 3.5" to 10", measured from end to end, and a diameter of between about 1" to 4", measured along the device diameter.

Other than the vessel, most of the components are reusable multiple times. Therefore, referring to FIGS. 11, 12A, 12B and 13, in an embodiment the disclosed technology provides for a reusable non-pyrotechnic diversionary assembly having a housing assembly, the housing assembly comprising a vessel (18) and a main chassis (12), wherein the housing supports a pressure manifold (14) and an activation assembly, as hereinabove generally and through embodiments described. In this embodiment the device further has a reloading tool (82) for re-cocking the activation assembly when threaded into the aperture aligned with the compressed gas support structure (when the gas cylinder is not present). As shown in FIGS. 11, 12A, 12B and 13, the reloading tool includes both an inner body (65) and an outer body (66) with an aperture at the distal end of the inner body sized to receive the puncture pin. The outer body of the reloading tool has a shaft sized and internally threaded to receive the inner body within the threaded shaft, and an exterior surface sized and threaded to be received and removably secured at its distal end within the threaded aperture (51) of the first manifold support structure on the pressure manifold (or other compressed gas support structure). The outer body and the inner body, or both, are designed and configured to control the position of the outer body relative to the aperture of the pressure manifold, and the position of the inner body relative to the puncture pin, allowing the inner body to rotate within the outer body in a manner to translate the puncture pin from its active position to its secured position.

When the reloading tool translates the puncture pin from the active position to the secured position, the same opposes the spring force of the main spring (19) and causes the puncture pin transfer bar (21) to rotate from its active position to its secured position, and by such rotation, the second end of the puncture pin transfer bar reloads the main spring. Further, the sear lever rotates between its active position to its secured position, engaging the rear trolley to translate from its active position to its secured position. The trolley assembly is captured within the top cap primarily by one or more guide rods (32, 41) which permit the lateral translation of the trolley assembly but constrain it in other axis.

In some embodiments the non-pyrotechnic diversionary device of the disclosed technology may be part of an assembly, including a plurality of vessels for individual, selective engagement with the main chassis, wherein at least some of the plurality of vessels comprises different materials, shapes, sizes, or prorogation crevice number, size or length, or any combination thereof, providing varying concussive force and sound intensity upon rupture. For example, vessels with increased propagation line depth produce reduced concussive force and reduced acoustic impulse output, suitable for training or non-tactical deployment.

In operation of a non-pyrotechnic diversionary device as hereinabove described, provided in the secured state, with a compressed gas cylinder and power source secured in the main chassis, the user pulls the pull pin from its apertures and deploys the device. Upon removal of the pull pin, the spoon lever no longer forces the spoon plunger to maintain the secured position, and the spring force of the trolley assembly is translated into its active position, releasing the sear lever of the fuse train assembly. As the sear lever rotates about its point of affixation, the puncture pin transfer bar is repositioned by means of the spring force of the main spring into its active position, translating the puncture pin to and into the membrane of a compressed gas cylinder. The compressed gas then flows through the orifice into the high pressure end of the main chassis and the vacuous area of the vessel, pressurizing the area at a fuse rate particular to the device, determined by the design of the routing cavities and size of the orifice. Once a burst pressure is reached (determined by the shape, material, wall thickness, and propagation lines of the vessel, typically between 100 and 700 psi), the vessel bursts, creating a concussive force and an acoustic impulse. Preferably, the vessel bursts along one or more of its propagation lines, and does not disintegrate or otherwise produce projectiles of portions of the vessel in the burst thereof. Upon burst, the pressure transducer circuit detects and communicates the depressurization of the high pressure side of the main chassis to the lighting assembly. As provided by the electrical circuitry of the lighting assembly, the LEDs (powered by the charged super capacitors) then emit light at a programmed flash profile (pulse length, pulse interval and, overall duration).

The device may then be recovered after use. To reuse the device, the burst vessel is removed and discarded, and the spoon lever and the pull pin are secured to the top of the vessel. This action causes the spoon plunger to be pushed into the device which rotates the sear lever into the secured upright position. The reloading tool is then secured in the aperture originally supporting the compressed gas source and rotated. Rotation of the reloading tool opposes the main spring, thereby rotating the puncture transfer bar into the secured position. A click will give the user audible feedback that the puncture pin transfer bar has been fully rotated into the secured position. The electrical energy source is secured or replaced, and once in position it comes into contact with the spring contact circuit board, thereby applying electrical potential to the main circuit to enabling recharging of the supercapacitors. A new gas cylinder and a new vessel are then secured to the main chassis, and the device of the disclosed technology is available for reuse.

While embodiments of the invention have been described above, the content disclosed herein is exemplary and not restrictive in all aspects. The technical scope of the invention is defined or indicated by the appended claims, and is intended to include all changes within the meaning and ranges of the claims and equivalents thereof.

The invention claimed is:

1. A non-pyrotechnic diversionary device comprising:

a. a housing assembly, the housing assembly comprising a vessel, a main chassis, and a transparent lens, wherein the vessel is removably secured to a first end of the main chassis and comprises a perimeter wall forming an open top and a vacuous area, the vessel perimeter wall having two or more propagation crevices extending from a pinnacle of a base of the vessel, along at least a portion of a length of the vessel, and the transparent lens is secured near the second end of the main chassis;

b. a pressure manifold, the pressure manifold comprising structure to support a compressed gas source;

c. an activation assembly, the activation assembly comprising a puncture pin aligned with the compressed gas source support structure; and d. a lighting assembly, the lighting assembly comprising a plurality of high-intensity lights and an energy source;

wherein the main chassis comprises a cylinder defining a vacuous area, with a firewall across the vacuous area of the main chassis to separate a high pressure side on the first end of the main chassis, and a low pressure side on the second end the main chassis, the main chassis sized and configured to receive and support the pressure manifold, the activation assembly, and the lighting assembly.

2. The non-pyrotechnic diversionary device of claim 1, wherein the perimeter wall of the vessel is defined by an interior surface and an exterior surface, forming the open top and the vacuous area within the vessel; and wherein the propagation crevices are on the interior surface of the perimeter wall.

3. The non-pyrotechnic diversionary device of claim 1, wherein the pressure manifold further comprises an orifice to control gas flow from the compressed gas source to the vessel, and pressure buildup within the high pressure side of the main chassis.

4. The non-pyrotechnic diversionary device of claim 1, wherein the pressure manifold is further designed and configured to support the energy source of the lighting assembly.

5. The non-pyrotechnic diversionary device of claim 3, wherein the compressed gas source support structure is a first manifold support structure; wherein the pressure manifold further comprises a base and a second manifold support structure to receive, support, and facilitate engagement of the energy source with the lighting assembly, the first and second manifold support structures being affixed to or integral with the base; wherein the puncture pin is aligned with an aperture of the first manifold support structure; and wherein the orifice is positioned through at least a portion of the first manifold support structure, the second manifold support structure, or the base, with an opening on a top face of the pressure manifold.

6. The non-pyrotechnic diversionary device of claim 5, wherein the pressure manifold further comprises one or more routing cavities within any of the base, the puncture pin, the first manifold support structure, and the second manifold support structure, to control the flow of gas from the compressed gas source to the vessel.

7. The non-pyrotechnic diversionary device of claim 1, wherein the perimeter wall has a thickness at the pinnacle of the vessel base of between about 1/32" and ⅛", and wherein the perimeter wall at the propagation crevices have a reduced thickness of between about ¼ to ½ of the thickness of the perimeter wall at the pinnacle of the base.

8. The non-pyrotechnic diversionary device of claim 1, wherein the propagation crevices are equidistant about a circumference of the vessel.

9. The non-pyrotechnic diversionary device of claim 1, wherein the exterior surface of the vessel perimeter wall comprises one or more ridges, wherein some of the ridges extend the entire length of the vessel, protruding at the vessel base to form a wedge; and wherein others of the ridges extend only partially along the length of the vessel, from the open top, and are aligned with the propagation crevices.

10. The non-pyrotechnic diversionary device of claim 1, wherein the firewall is integral with the main chassis and supports the pressure manifold, with an aperture formed in the firewall to receive the puncture pin of the activation assembly, a first recessed area receiving a pressure transducer for engagement with the lighting assembly and a second recessed area receiving a spring contact for engagement with the energy source.

11. The non-pyrotechnic diversionary device of claim 1, further comprising a compressed gas source consisting of a compressed gas cylinder having a puncturable membrane at one end.

12. The non-pyrotechnic diversionary device of claim 1, further comprising a top cap, wherein the top cap is removably secured to the second end of the main chassis.

13. The non-pyrotechnic diversionary device of claim 12, wherein the activation assembly further comprises a spoon lever and a fuse train assembly; and wherein the spoon lever is rotatably secured to the top cap, designed and configured to secure the fuse train assembly in a secured position, and by its rotation to release the fuse train assembly to an active position.

14. The non-pyrotechnic diversionary device of claim 13, wherein the fuse train assembly comprises a. a fuse train housing;
b. a sear lever rotatably mounted on the fuse train housing at a first end;
c. a puncture pin transfer bar rotatably aligned with the fuse train housing, engaged at a first end with the puncture pin and the sear lever; and
d. a main spring secured within the fuse train housing, and aligned with a second end of the puncture pin transfer bar.

15. The non-pyrotechnic diversionary device of claim 14, wherein the activation assembly further comprises a trolley assembly engaged with the spoon lever and the fuse train assembly, the trolley assembly having a spoon plunger, a spring-loaded front trolley slider, and a spring-loaded rear trolley slider, wherein the spoon plunger is engaged with the spoon lever to move the spoon lever into an active position when the trolley is released into its active position; and wherein the front trolley slider or the rear trolley slider, or both, have elongated receptacles along at least a central portion thereof to receive and secure a second end of the sear lever of the fuse train assembly when the trolley is in a secured position, and release the sear lever when the trolley is in its active position.

16. The non-pyrotechnic diversionary device of claim 1, wherein the lighting assembly further comprises a pressure detection assembly and a light controlling circuitry to control operation of the lights, and wherein the energy source comprises a plurality of supercapacitors.

17. The non-pyrotechnic diversionary device of claim 16, wherein the pressure detection assembly comprises a pressure sensor for detecting pressure within the vacuous area of the vessel, and circuitry to communicate a condition of pressure drop on the high pressure side of the main chassis to the lighting device, wherein the condition of pressure drop is caused by the rupture of the vessel, and sensed by the pressure sensor, and wherein a transducer of the pressure sensor is affixed to and supported in a recess of the main chassis, on the high pressure side of the firewall.

* * * * *